US006481910B1

(12) United States Patent
Yang

(10) Patent No.: US 6,481,910 B1
(45) Date of Patent: Nov. 19, 2002

(54) TOOTHBRUSH WITH REFILLING OF TOOTHPASTE

(76) Inventor: Ching-Yuan Yang, P.O. Box No. 6-57, Chung-Ho, Taipei 235 (TW)

( * ) Notice: Subject to any disclaimer, the term of this patent is extended or adjusted under 35 U.S.C. 154(b) by 0 days.

(21) Appl. No.: 10/014,866

(22) Filed: Dec. 14, 2001

(51) Int. Cl.[7] ..... A46B 11/02

(52) U.S. Cl. ..... 401/175; 401/269; 401/277; 401/281

(58) Field of Search ..... 401/173, 174, 401/175, 269, 277, 281, 280

(56) References Cited

U.S. PATENT DOCUMENTS 3,995,648 A * 12/1976 Kuryla ..... 401/175 X
4,135,831 A * 1/1979 Reitknecht ..... 401/175
4,149,552 A * 4/1979 Stewmon ..... 401/175 X
4,288,169 A * 9/1981 McMenamin, IV ..... 401/175
5,066,155 A * 11/1991 English et al. ..... 401/175

* cited by examiner

*Primary Examiner*—David J. Walczak
*Assistant Examiner*—Kathleen J. Prunner

(57) ABSTRACT

A toothbrush consists of a cylindrical brush handle forming a toothpaste receiver having toothpaste therein, a brush rod provided with brush bristles and a guide passage therein, a turning end cap formed with a threaded rod extending into the toothpaste receiver and a squeezing block threadingly engaging the threaded rod in the toothpaste receiver. When the end cap is turned, the squeezing block may be actuated to move forward or backward such that the toothpaste may be squeezed toward the brush rod to overflow over the brush bristles through the guide passage. By opening a seal lid of the turning end cap, a general toothpaste tube can be squeezed so that the toothpaste refills the toothpaste receiver during refilling.

8 Claims, 3 Drawing Sheets

TOOTHBRUSH WITH REFILLING OF TOOTHPASTE

BACKGROUND OF THE INVENTION (a) Field of the Invention

The present invention relates to a toothbrush that is refilled with toothpaste, and particularly to an improvement on a toothbrush with refilling of toothpaste.

(b) Description of Related Art

In this highly industrialized society, we often have a chance to stay out for business or traveling and a toilet set, which contains at least a toothbrush, toothpaste, a towel, and soap, usually is an essential part of personal belongings carried along. However, sometimes, one or two items in the toilet set may be forgotten for instance, the toothbrush has been prepared but the toothpaste has been carelessly forgotten. Hence, the teeth are brushed roughly or tumbled with water instead. As a result, the personal hygiene and the body health are affected unconsciously. Even more, the foul breath may result in rough manners to others unintentionally. The simply packed hygienic toothbrush in the hotel usually provides poor quality such that bristles on the toothbrush may sting the mouth or fall off during brushing. Even if the toothbrush provided by the hotel is expensively made with better quality, it is wasteful because usually the toothbrush in the hotel is discarded after using once. If the toothbrush is going to be used for a second time or third time, the toothpaste offered by the hotel runs out.

Besides, our contemporaries pay more attention to hygiene than before and a lot of people are used to brushing their teeth more than once a day such that it is quite inconvenient to carry with them the toothbrush and the toothpaste every morning when they are going out to work. Moreover, we also have had an experience with regard to forgetting to brush the teeth or being unable to brush in time when we are going out in the morning. Therefore, an easily portable toothbrush containing the toothpaste may solve the problem of the toothbrush and the toothpaste being carried separately and it is a great contribution for the daily life of everybody.

SUMMARY OF THE INVENTION

The object of the present invention is to combine the conventional toothpaste and the toothbrush together that are usually carried separately. A brush handle has the toothpaste therein such that a pushing and squeezing device can be used to obtain the proper amount of toothpaste on the brush bristles by simply turning an end cap. Furthermore, by opening a seal lid on the end cap, toothpaste from a general longitudinal tube of toothpaste can be used to refill the brush handle in an easy and hygienic process.

BRIEF DESCRIPTION OF THE DRAWINGS

The feature and the novelty of the present invention will be fully understood by the explanation of the following drawings.

DETAILED DESCRIPTION OF PREFERRED EMBODIMENTS

Figure 1:
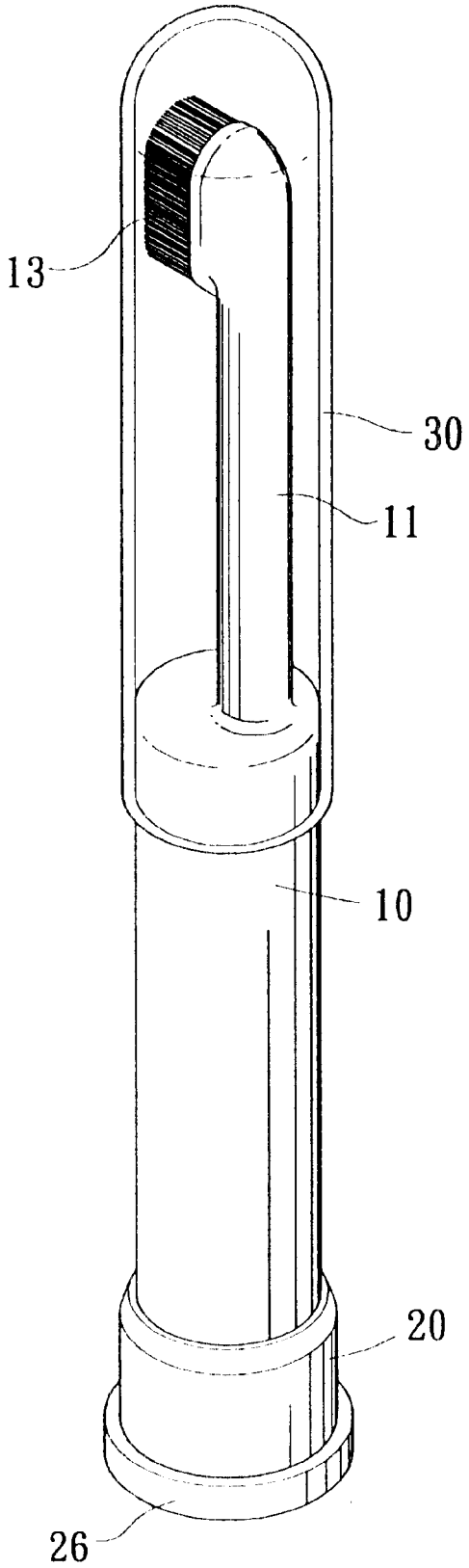
FIG. 1 is a perspective view of the present invention in an assembly state.
Figure 2:
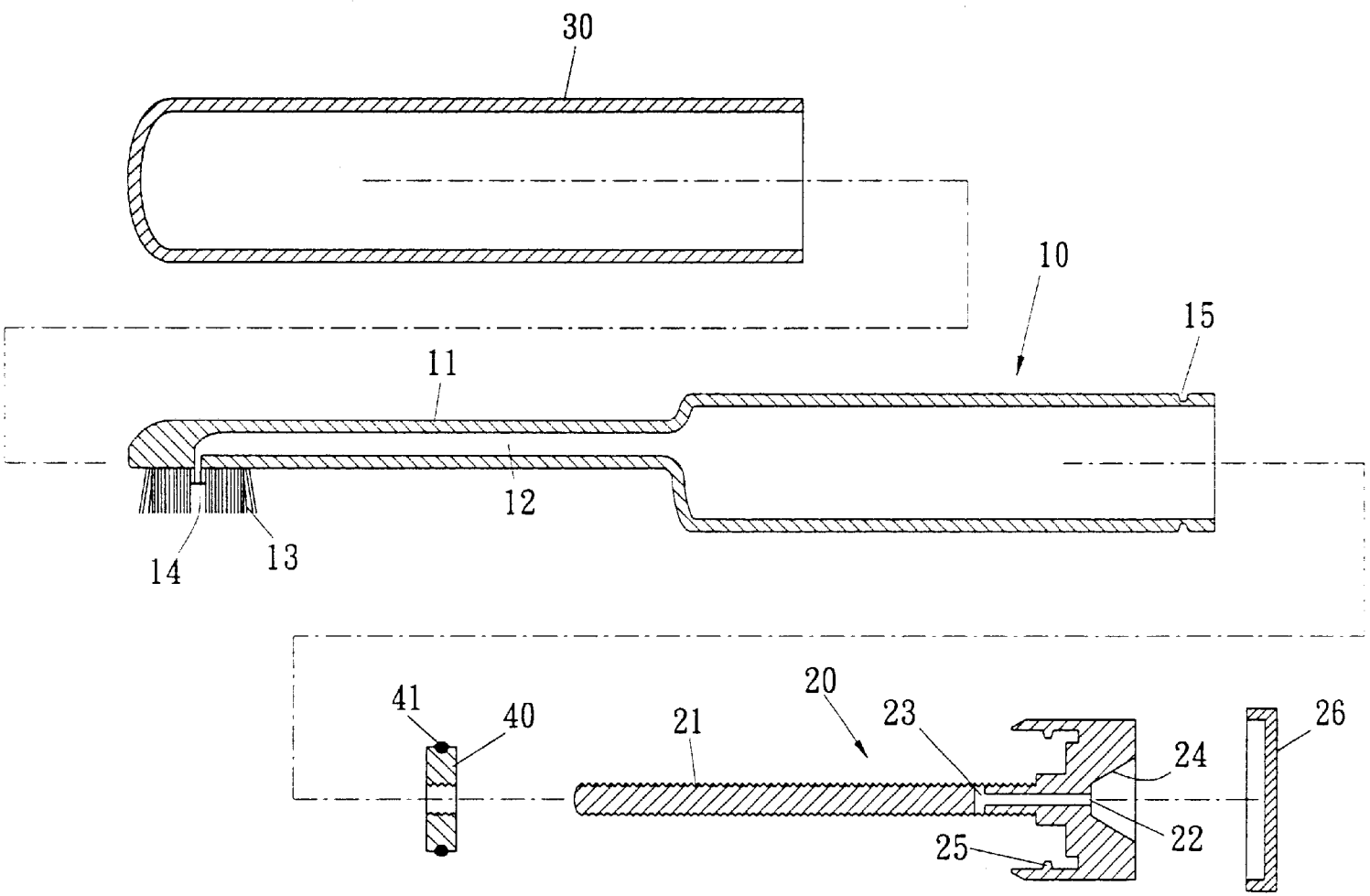
FIG. 2 is an exploded sectional view of the present invention.

Referring to FIGS. 1 and 2, the present invention is mainly a cylindrical hollow brush handle 10 having a hollow space forming a toothpaste receiver and having a brush rod 11 disposed at the front end of the brush handle 10 with a guide passage 12 therein communicating with the hollow space of the brush handle. The front end of the brush rod 11 is provided with brush bristles 13 and an overflow end 14 of the guide passage 12 is higher than the root end of the brush bristles 13 such that the squeezed toothpaste moves to the overflow end 14 along the guide passage 12. A protective lid 30 is used for covering the brush bristles 13 for hygiene and protection.

Figure 3:
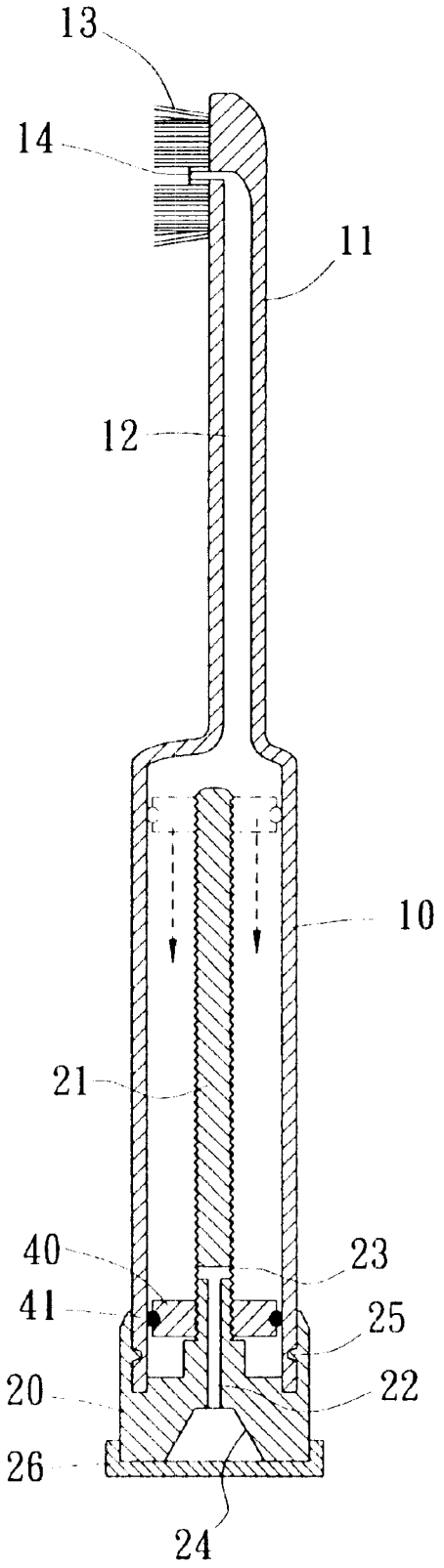
FIG. 3 is a cross sectional view of the present invention in an assembly state.

Referring to FIGS. 2 and 3, the rear end of the brush handle 10 is provided with an annular recess 15 on its outer surface which engages an annular projection 25 of a turning end cap 20 to form an engagement which enables the turning end cap 20 to be easily turned by fingers. The inner central part of the turning end cap 20 is integrally formed with a threaded rod 21 extending therefrom. The brush handle 10 is provided with a movable squeezing block 40 which threadingly engages the threaded rod 21 so as to move backward and forward along the rod 21 with the rotating of the turning end cap 20. The forward movement of the squeezing block 40 forces toothpaste in the brush handle 10 to move toward the brush bristles through the guide passage 12 in the brush rod 11. The periphery of the squeezing block 40 is surrounded by an annular groove to receive a resilient seal ring 41. The rear end of the turning end cap 20 is provided with the refill guide passage 22 extending along the central axis of the threaded rod 21 to a second guide passage 23 communicating with the hollow space of the brush handle 10. The refill guide passage 22 is centrally positioned with an exposed end which forms a cone shaped opening 24 to receive different diameters of longitudinal toothpaste tubes. The rear end of the turning end cap 20 is disposed a seal lid 26 to close and cover the opening 24 and the refill guide passage 22 after filling.

The other embodiment of the present invention is to provide a plurality of longitudinal projecting ribs disposed along an inner surface of the toothpaste receiver in order to increase the friction thereof and assure the engagement of squeezing block without rotating along with the movement of a turning end cap.

Another embodiment of the present invention is to provide an inner surface of the toothpaste receiver with a longitudinal projecting rib therein. A groove is disposed on the periphery of the squeezing block and corresponds with the projecting rib to assure the engagement of the squeezing block without rotating along with the movement of the turning end cap.

As mentioned above, the structure of the present invention effectively combines the toothbrush and the toothpaste becoming portable and a self-supply. Furthermore, it is not only possible to obtain a proper amount of toothpaste for refilling in a convenient way, but also to maintain hygiene and protection because of the design of the protective lid for covering the brush bristles. Accordingly, the present invention is durable for being conveniently used for a long period of time regardless at home or carrying out of home.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A toothbrush which is refilled with toothpaste comprising:

a brush handle provided with a hollow space forming a toothpaste receiver, a brush rod extends from a front end of the brush handle and is provided with a guide passage therein which communicates with the hollow space of the brush handle, brush bristles extend outwardly from an end of the brush rod, a rotating turning end cap is attached to a rear end of the brush handle, a threaded rod is integrally formed with the cap and extends from a central position thereof, the hollow brush handle is provided with a squeezing block which threadingly engages the threaded rod so as to is provided move backward and forward along the rod with the rotating of the turning end cap, the forward movement of the squeezing block forces toothpaste in the brush handle to move toward the brush bristles through the guide passage in the brush rod, characterized in that:

the rear end of the brush handle is provided with an annular recess on its outer surface which engages an annular projection extending from an inner surface of the turning end cap such the the turning end cap is easily rotated by finger; the turning end cap is provided with a refill guide passage extending along the central axis of the threaded rod to a second guide passage communicating with the hollow space of the brush handles; and an outer end of the turning end cap is provided with a removable seal lid to close and cover the refill guide passage after the toothpaste receiver has been filled with toothpaste.

2. The toothbrush according to claim 1, wherein an overflow end of the guide passage in the brush rod is higher than the root end of the brush bristles.

3. The toothbrush according to claim 1, wherein the guide passage of the threaded rod is located forward of the squeezing block when the squeezing block is moved backward to the base end of the threaded rod.

4. The toothbrush according to claim 1, wherein the periphery of the squeezing block is surrounded with an annular groove in order to receive a resilient seal ring.

5. The toothbrush according to claim 1, wherein the passage of the turning end cap has an exposed end which is cone shaped.

6. The toothbrush according to claim 1, wherein a protective lid is used for covering the brush bristles.

7. The toothbrush according to claim 1, further comprising a plurality of longitudinal projecting ribs disposed along the inner surface of the toothpaste receiver in order to increase the friction and assure engagement of the squeezing block without rotating along with the movement of the turning end cap.

8. The toothbrush according to claim 1, further comprising the inner surface of the toothpaste receiver being provided with a longitudinal projecting rib and the periphery of the squeezing block being provided with a groove which corresponds with the projecting rib.

* * * * *